US007098173B2

(12) United States Patent
Calcut et al.

(10) Patent No.: US 7,098,173 B2
(45) **Date of Patent: *Aug. 29, 2006**

(54) THERMALLY STABLE ANTIFOAM AGENT FOR USE IN AUTOMATIC TRANSMISSION FLUIDS

(75) Inventors: Brent D. Calcut, Allen Park, MI (US); Thomas J. Chapaton, Sterling Heights, MI (US); Reuben Sarkar, Novi, MI (US); Marie-Christine G. Jones, Bingham Farms, MI (US)

(73) Assignee: General Motors Corporation, Detroit, MI (US)

( * ) Notice: Subject to any disclaimer, the term of this patent is extended or adjusted under 35 U.S.C. 154(b) by 562 days.

This patent is subject to a terminal disclaimer.

(21) Appl. No.: 10/299,595

(22) Filed: Nov. 19, 2002

(65) Prior Publication Data

US 2004/0097384 A1 May 20, 2004

(51) Int. Cl.
*C10M 147/04* (2006.01)

(52) U.S. Cl. ..... 508/582; 252/77

(58) Field of Classification Search ..... 508/582
See application file for complete search history.

(56) References Cited

U.S. PATENT DOCUMENTS 3,445,392 A * 5/1969 Gumprecht et al. ..... 508/582
3,775,324 A * 11/1973 McCoy et al. ..... 508/507
4,411,806 A 10/1983 Tirtiaux et al.
4,549,004 A 10/1985 von Au et al.
4,648,475 A 3/1987 Veglia
4,675,452 A * 6/1987 Lagow et al. ..... 568/601
4,820,774 A 4/1989 Takao et al.
4,826,905 A 5/1989 Itoh et al.
4,974,569 A 12/1990 Ampferer et al.
4,993,381 A 2/1991 Absenger
5,000,864 A * 3/1991 Strepparola et al. ..... 428/835.8
5,061,759 A 10/1991 Tommasi et al.
5,076,949 A * 12/1991 Kalota et al. ..... 508/582
5,120,459 A * 6/1992 Kalota et al. ..... 508/582
5,174,916 A * 12/1992 Osgood ..... 508/582
5,208,293 A 5/1993 Oki et al.
5,316,686 A * 5/1994 Snyder et al. ..... 508/582
5,349,004 A 9/1994 Kumar et al.
5,376,289 A * 12/1994 Montagna et al. ..... 508/425
5,435,927 A * 7/1995 Beckwith et al. ..... 508/501
5,482,991 A 1/1996 Kumar et al.
5,498,359 A * 3/1996 Shinomoto et al. ..... 508/207
5,620,499 A 4/1997 Farley
5,648,419 A 7/1997 Kendall
5,663,127 A * 9/1997 Flynn et al. ..... 508/250
5,858,935 A * 1/1999 Watts et al. ..... 508/491
5,908,686 A 6/1999 Sudo et al.
5,912,291 A 6/1999 Sterling et al.
6,013,740 A 1/2000 Burns et al.
6,090,758 A 7/2000 Pillon et al.
6,303,675 B1 10/2001 Kobayashi et al.
6,403,105 B1 6/2002 Stein
6,429,258 B1 8/2002 Morgan et al.
6,431,473 B1 8/2002 Shouji et al.
6,468,947 B1 10/2002 Falcone et al.
6,515,069 B1 2/2003 Gervasi et al.
6,759,375 B1 7/2004 Curtis et al.

FOREIGN PATENT DOCUMENTS

JP 60022909 A 2/1985

OTHER PUBLICATIONS

Smalheer et al, "Lubricant Additives", Section I-Chemistry of Additives, p. 1-11, 1967.*
Bergeron et al., "Polydimethylsiloxane (PDMS)-based antifoams", Colloids & Surfaces A: Physicochemical & Engineering Aspects 122, 1997, pp. 103-120.

* cited by examiner

*Primary Examiner*—Ellen M. McAvoy
(74) *Attorney, Agent, or Firm*—Christopher DeVries

(57) ABSTRACT

Antifoam compositions for automatic transmission fluids contain antifoam agents comprising perfluoropolyether compounds (PFPE). An automatic transmission fluid is provided containing the antifoam composition in a lubricating base oil, along with conventional additives such as antiwear agents. Automobile transmissions are provided that contain an automatic transmission fluid containing the new antifoam compositions. In a further embodiment, methods are provided for reducing unwanted noise in an automobile transmission during operation, comprising lubricating the transmission with an ATF containing the antifoam compositions of the invention.

28 Claims, No Drawings

THERMALLY STABLE ANTIFOAM AGENT FOR USE IN AUTOMATIC TRANSMISSION FLUIDS

TECHNICAL FIELD

The present invention relates to automatic transmission fluids (ATFs) for use in automatic transmissions, and more specifically to the use of antifoam agents in ATFs and/or in ATF additive systems.

BACKGROUND OF THE INVENTION

Automatic transmission fluids (ATF) are non-compressible lubricant compositions containing a number of conventional additives. As typically used, an ATF serves as a hydraulic fluid, activating and engaging gears in the transmission by a series of valves and other hydraulic circuits, and as a lubricant for the hydraulic pump used to provide hydraulic pressure for operation of the transmission.

ATFs generally contain detergent and similar additives that tend to produce foam if air is entrained into the fluid. Additionally, impurities are produced in the fluid over time (for example, by oxidation or degradation of the base oil), some of which may contribute to a foaming tendency in the ATF. Entrained air in an ATF is a problem because the air alternately expands in the low pressure inlet side of pump, and quickly contracts or is compressed as the fluid passes through the pump to the high pressure outlet side.

The resulting implosion of air bubbles on the outlet side causes pressure ripples in the hydraulic pump. The pressure ripples can cause objectionable audible noise, manifested as "pump whine" in some transmissions. New automatic transmissions, such as continuously variable transmissions (CVT), with their compact sumps and high pump pressures, have raised the possibility of consumer reaction to the noise. In response, a number of OEMs have taken steps to reduce the air level in the fluid of their new transmissions by isolating or baffling the internal rotating components to separate them from the fluid, or by introducing aeration additives into the ATF to help the oil release the entrained air more quickly or otherwise reduce the level of entrained air. Additionally, conventional antifoam agents have been employed to help dissipate surface air bubbles.

Antifoams work in part by being insoluble in ATF. As such, they function in part by having a preferential tendency to reside on the surface of bubbles. However, in hydraulic pumps, the act of adiabatically compressing entrained air on the outlet side causes the surface of air bubbles to reach high temperatures. In some cases, the temperature may reach 500° C. or greater. At such elevated temperatures, the antifoam agent is subject to thermal degradation. Because some conventional antifoam agents, such as polydimethylsilicone, are thermally stable only up to about 200° C., they are subject to thermal breakdown in the modern transmission environment.

Antifoam agents need to be dispersed, but not dissolved, in the form of liquid droplets above a minimum size in order to be functional in an ATF. Thermal degradation of the molecules of the antifoam agent inhibits the ability of the antifoam agent molecules to form droplets of effective size. Thermal degradation of the antifoam agent and/or change in the properties of the ATF can result in antifoam agent molecules that are undesirably further solubilized (i.e., dissolved) in the ATF, such that they are no longer functional as antifoams; they may even become foaming agents.

The insolubility of the antifoam agents leads to some difficulties that must be addressed by the formulator of ATF. Typically, the antifoam agent is denser than the base fluids and tends to fall out during shipping and storage before being added to the transmission. In practice, this limits the amount of antifoam agent that can be incorporated or dispersed into the ATF by the fluid supplier. Alternatively, a formulated ATF may be re-dispersed prior to filling the transmission, but the extra step creates additional expense in the manufacturing process.

SUMMARY OF THE INVENTION

Many of the difficulties discussed above are overcome and advantages are provided by the use of a new antifoam composition in automatic transmission fluids. The antifoam compositions contain antifoam agents comprising perfluoropolyether compounds (PFPE). In one aspect, an automatic transmission fluid is provided containing the antifoam composition in a lubricating base oil, along with conventional additives such as antiwear agents. In another embodiment, automobile transmissions are provided that contain an automatic transmission fluid containing the new antifoam compositions of the invention. In a further embodiment, methods are provided for reducing unwanted noise in an automobile transmission during operation, comprising lubricating the transmission with an ATF containing the antifoam compositions of the invention.

In another embodiment, a method for top treating an automatic transmission fluid in an automobile transmission is provided. The method comprises adding to the fluid in the transmission an aliquot of an antifoam composition of the invention. In a further embodiment, methods are provided for manufacture and maintenance of automobile transmissions. The methods involve top treating a transmission containing an automatic transmission fluid with an aliquot containing the antifoam composition of the invention. Such top treatment may be carried out, for example, at the transmission assembly plant, the automobile assembly plant, or in the aftermarket by an automotive repair shop or the consumer.

Further areas of applicability of the present invention will become apparent from the detailed description provided hereinafter. It should be understood that the detailed description and specific examples, while indicating preferred embodiments of the invention, are intended for purposes of illustration only and do not limit the scope of the invention.

DESCRIPTION OF THE PREFERRED EMBODIMENT

The following description of the preferred embodiment(s) is merely exemplary in nature and is in no way intended to limit the invention, its application, or uses.

A transmission fluid, preferably an automatic transmission fluid (ATF), is provided comprising a lubricating oil, an antifoam composition, and conventional additives. Preferably, the transmission fluid contains an antiwear agent present at a level sufficient to provide antiwear protection for the components of the transmission. According to a further embodiment, a transmission is provided comprising a housing defining a lubricant sump. The lubricant sump contains a lubricating oil composition comprising a transmission fluid as discussed above.

The use of the transmission fluids of the invention provides advantages in reducing the noise or "pump whine" caused by entrained air in the transmission fluid. Thus, in a further embodiment, a method for reducing noise during operation of an automobile transmission is provided. The method comprises lubricating the transmission with an ATF as discussed above.

In a further embodiment, a method of treating a transmission is provided. The transmission contains a housing defining a lubricant sump, and the lubricant sump contains a lubricating composition. The method of treating comprises adding to the lubricating composition in the sump a top treat composition comprising an antifoam composition of the invention.

In another embodiment, methods are provided for reducing unwanted noise in an operating transmission. The method comprises top treating the lubricating composition in a lubricant sump with a composition containing an antifoam compound that is thermally stable, as measured by differential thermal analysis to a temperature of higher than 200° C., preferably higher than 400° C., and more preferably higher than 500° C.

The composition, transmission, and methods of the invention are based on the use of a new antifoam composition for automatic transmission fluids. The antifoam compositions of the invention contain perfluoropolyether compounds (PFPEs). The PFPEs of the invention function to reduce foam in the transmission fluid during operation. The reduction in foam leads to a diminution of noise caused by entrained air in the hydraulic system.

Perfluoropolyether compounds are polymers containing a plurality of ether groups in the background chain of the polymer, and wherein some or all of the carbon hydrogen bonds of a standard polyether are replaced by carbon fluorine bonds. In one embodiment, the perfluoropolyether compound comprises a plurality of $—(C_aF_{2a}O)—$ repeating units wherein a is from 1 to 10. Non-limiting examples of such repeating units include the following:

$$—(CF_2—CF(CF_3)—O)—$$

$$—(CF_2—CF_2—CF_2—O)—$$

$$—(CF_2—CF_2—O)—$$

In another embodiment, the PFPE compounds contain repeating units of $—(C_bF_{2b}O)—$ and $—(CF_2O)—$ wherein b is from 2 to 10.

Perfluoropolyether compounds of the invention can be synthesized by methods well known in the art. In a non-limiting example, they may be synthesized by polymerizing perfluoroolefins in the presence of an oxidizing agent. Non-limiting examples of perfluoroolefins include tetrafluoroethylene and hexafluoropropylene.

The perfluoropolyerher compounds comprise a backbone having repeating perfluoroether units as described above, and in addition are further characterized by two end groups at either end of the perfluoropolyether chain. As described further below, the end groups of the perfluoropolyether compound may be non-functional, in the case of a halogen atom, a perfluoroalkoxy group, and a perfluoroalkyl group, or may contain a number of different functional groups. Non-limiting examples of functional groups include alkyl amide, silane, phosphate, phosphate esters, carboxyl, organic ester, and hydroxyl. Thus, representative structures of perfluoro polyether compounds are given as:

$$R^1—(—CF(CF_3)—CF_2—O—)_n—R^2 \quad (I)$$

$$R^1—(—CF_2—CF_2—CF_2—O—)_n—R^2 \quad (II)$$

$$R^1—(—CF_2O—)_n—(—CF_2—O—)_m—R_2 \quad (III)$$

$$R^1—(—CF_2—CF(CF_3)—O—)_n—(—CF_2—O—)_m—R^2 \quad (IV)$$

where $R^1$ and $R^2$ comprise the functional or non-functional end groups noted above. As is conventional, the subscripts n and m refer to the number of respective repeating units in the backbone of the PFPE. The values of the m and a determine the molecular weight of the PFPE.

Generally, PFPEs of the invention should be relatively insoluble in the lubricating base oil of the transmission fluid, and have a viscosity in the range of approximately 1 to 150,000 centistokes. The PFPEs generally have a density greater than the lubricating oil, and as such will settle out of the transmission fluid during rest and sit at the bottom of the sump. It is believed that if the viscosity of the PFPE is greater than about 150,000 centisokes, the PFPE will be difficult to re-disperse into the transmission fluid upon operation, especially on cold winter days. Accordingly, PFPEs of the invention are selected with values of n and m such that the viscosity is in the preferred range. As a practical matter, n should be at least about 3. In one preferred commercial embodiment, the sum of m+n is from about 8 to about 45. In another embodiment, the sum of m+n is from about 40 to about 180. PFPEs of formula I are commercially available where n=44–45, where n=19, and with n=13–14. Commercial embodiments of formula IV are available with m+n from 40–180 and the ratio m/n in the range of 0.5–2.0. In another commercial embodiment, the sum of m+n is from 8–45 and the ratio m/n is from 20–1,000. PFPEs of the invention are commercially available, for example under the Fomblin® line of Ausimont or the Krytox® line of DuPont. Non-limiting commercial examples of PFPEs suitable for use in the transmission fluid of the invention are given in Table 1.

TABLE 1

| Supplier | Tradename | Structure |
|---|---|---|
| Solvey/Ausimont | Fomblin W500 | Mixture of:<br>$F_3CO(CF(CF_3)CF_2O)_m(CF_2O)_nCF_3$<br>m + n = 8–45, m/n = 20–1,000 and<br>$F_3CO(CF_2CF_2O)_m(CF_2O)_nCF_3$<br>m + n = 40–180, m/n = 0.5–2.0 |
| Solvey/Ausimont | Fomblin M60 | $F_3CO(CF_2CF_2O)_m(CF_2O)_nCF_3$<br>m + n = 40–180, m/n = 0.5–2.0 |

TABLE 1-continued

| Supplier | Tradename | Structure |
|---|---|---|
| Dupont | Krytox GPL 107 | $F(CF(CF_3)CF_2O)_nCF_2CF_3$<br>n = 44–45 |
| Dupont | Krytox GPL 104 | $F(CF(CF_3)CF_2O)_nCF_2CF_3$<br>n = 19 |
| Dupont | Krytox GPL 103 | $F(CF(CF_3)CF_2O)_nCF_2CF_3$<br>n = 13–14 |
| Dupont | Krytox GPL 105 | $F(CF(CF_3)CF_2O)_nCF_2CF_3$<br>n = 28 |
| Solvey/Ausimont | Fomblin Y06 | $F_3CO(CF(CF_3)CF_2O)_m(CF_2O)_nCF_3$<br>m + n = 8–45; m/n = 20–1,000 MW = 1,800 |
| Solvey/Ausimont | Fomblin M30 | $F_3CO(CF_2CF_2O)_m(CF_2O)_nCF_3$<br>m + n = 40–180; m/n = 0.5–2.0 |
| Solvey/Ausimont | Fomblin Y25 | $F_3CO(CF(CF_3)CF_2O)_m(CF_2O)_nCF_3$<br>m + n = 8–45; m/n = 20–1,000 MW = 3,200 |
| Solvey/Ausimont | Fomblin M15 | $F_3CO(CF_2CF_2O)_m(CF_2O)_nCF_3$<br>m + n = 40–180, m/n = 0.5–2.0 |

In the examples given above, the end groups $R^1$ and $R^2$ are respectively selected from the group consisting of fluorine atom, a perfluoroalkoxy group, and a perfluoroalkyl group. In a preferred embodiment, the perfluoroalkyl group is a trifluoromethane group, —$CF_3$. Other perfluoroalkyl groups include —$C_nF_{2n+1}$, wherein n is from 2 to 10. In another preferred embodiment, the perfluoroalkoxy group is a trifluoromethoxy group, —$OCF_3$. Other perfluoroalkoxy groups include —$OC_nF_{2n+1}$, wherein n is from 2 to 10.

The PFPEs of the invention generally exhibit low pour points that allow them to be used advantageously at low temperatures. The pour point is preferably −20° C. or lower, more preferably −40° C. or lower, and even more preferably −60° C. or lower. In addition, the PFPEs exhibit favorable volatility, expressed as evaporation weight loss according to ASTM D2595. Preferably, the percentage weight loss at a given temperature will be 20% or less, more preferably 10% or less, and even more preferably 1% or less, measured at temperatures of 120° C. −204° C. These and other physical properties of some commercially available PFPEs of the Fomblin line axe given in Tables 2, 3, and 4.

TABLE 2

| | Fomblin Y Lubricant Grades | | | | | | |
|---|---|---|---|---|---|---|---|
| Typical Properties | Y04 | Y06 | Y25 | Y45 | YR | YR1500 | YR1800 |
| Approximate ISO grade | 15 | 22 | 100 | 150 | 320 | 460 | 460 |
| Molecular weight (AMU) | 1,500 | 1,800 | 3,200 | 4,100 | 6,250 | 6,600 | 7,250 |
| Kinematic viscosity (ASTM D445) | | | | | | | |
| 20° C. (cSt) | 38 | 60 | 250 | 470 | 1200 | 1500 | 1850 |
| 40° C. (cSt) | 15 | 22 | 80 | 147 | 345 | 420 | 510 |
| 100° C. (cSt) | 3.2 | 3.9 | 10 | 16 | 33 | 40 | 47 |
| Viscosity index (ASTM D2270) | 60 | 70 | 108 | 117 | 135 | 135 | 135 |
| Pour point (° C.) (ASTM D97) | −58 | −50 | −35 | −30 | −25 | −25 | −20 |
| Evaporation weight loss (ASTM D2595) | | | | | | | |
| 120° C., 22 hr (%) | 14 | 6 | — | — | — | — | — |

TABLE 2-continued

| Typical Properties | Fomblin Y Lubricant Grades | | | | | | |
|---|---|---|---|---|---|---|---|
| | Y04 | Y06 | Y25 | Y45 | YR | YR1500 | YR1800 |
| 149° C., 22 hr (%) | — | 20 | 2 | 0.7 | 0.5 | 0.3 | — |
| 204° C., 22 hr (%) | — | — | 15 | 1.7 | 1.2 | 0.9 | 0.5 |

TABLE 3

| Typical Properties | Fomblin Z Lubricant Grades | | | |
|---|---|---|---|---|
| | Z03 | Z15 | Z25 | Z60 |
| Approximate ISO grade | 15 | 100 | 150 | 320 |
| Molecular weight (AMU) | 4000 | 8000 | 9,500 | 13,000 |
| Kinematic viscosity (ASTM D445) | | | | |
| 20° C. (cSt) | 30 | 160 | 263 | 600 |
| 40° C. (cSt) | 18 | 92 | 157 | 355 |
| 100° C. (cSt) | 5.6 | 28 | 49 | 98 |
| Viscosity index (ASTM D2270) | 317 | 334 | 358 | 360 |
| Pour point (° C.) (ASTM D97) | −90 | −80 | −75 | −63 |
| Evaporation weight loss (ASTM D2595) | | | | |
| 149° C., 22 hr (%) | 6.0 | 0.2 | — | — |
| 204° C., 22 hr (%) | n.a. | 1.2 | 0.4 | 0.2 |

TABLE 4

| Typical Properties | Fomblin M Lubricant Grades | | | |
|---|---|---|---|---|
| | M03 | M15 | M30 | M60 |
| Approximate ISO grade | 15 | 100 | 150 | 320 |
| Molecular weight (AMU) | 4000 | 8000 | 9,800 | 12,500 |
| Kinematic viscosity (ASTM D445) | | | | |
| 20° C. (cSt) | 30 | 150 | 280 | 550 |
| 40° C. (cSt) | 17 | 85 | 159 | 310 |
| 100° C. (cSt) | 5 | 22 | 45 | 86 |
| Viscosity index (ASTM D2270) | 253 | 286 | 338 | 343 |
| Pour point (° C.) (ASTM D97) | −85 | −75 | −65 | −60 |
| Evaporation weight loss (ASTM D2595) | | | | |
| 149° C., 22 hr (%) | 6.5 | 0.8 | — | — |
| 204° C., 22 hr (%) | — | 3.0 | 0.7 | 0.4 |

PFPEs of the invention may also include functionalized PFPEs, wherein $R^1$ and $R^2$ in formulas I–IV are other than halogen, perfluoroalkoxy, and perfluoroalkyl. Such functional groups include, without limitation, alkyl amide, silane, phosphate, phosphate esters, carboxyl, carboxyl esters, and hydroxyl. If used, the functionalized PFPEs should be limited to an amount that does not adversely affect the antifoam property of the antifoam composition containing them. In a preferred embodiment, non-functional PFPEs are used along with functionalized PFPEs. With this in mind, functionalized PFPEs may be chosen for use as antifoam agents.

In one embodiment, the end groups $R^1$ and $R^2$ are independently represented by $A^1$—$CF_2O$— and-$CF_2$-$A^2$, respectively. The groups $A^1$ and $A^2$ may be the same or different, and may be hydrogen, fluorine, or chlorine. In a preferred embodiment, at least one, and preferably both, of $A^1$ and $A^2$ comprise functional groups including carboxyl, amide, silane, hydroxyl, and phosphate. Non-limiting examples of $A^1$ and $A^2$ include

-$CONHR_H$;

-Ak-OH;

-Ak-$Si(OR_H)_3$;

—$COOR_H$;

—$CH_2(OCH_2CH_2)_pOH$;

—$CH_2OCH_2CH(OH)CH_2OH$; and

—Ak-$OP(O)(OH)_2$ wherein $R_H$ is H or an alkyl group with 1 to 10 carbon atoms, Ak is a bond or an alkylene group with 1 to 10 carbon atoms, and p is from 1 to about 20.

In another embodiment, the PFPEs are represented by a formula $Cl(CF_2CF(CF_3)O)_nCF_2$—B, wherein B is the same as $A^1$ or $A^2$ above.

Functionalized PFPEs are well known in the art and are commercially available. For example, they are available under the Fluorolink® line from Ausimont and under the Krytox line of Dupont. Non-limiting examples of commercially available functionalized PFPEs are given in Table 5.

TABLE 5

| Supplier | Tradename | Structure |
|---|---|---|
| Solvey/Ausimont | Fluorolink S10 | $(EtO)_3Si(CH_2)_3F_2CO(CF_2CF_2O)_m(CF_2O)_nCF_2(CH_2)_3Si(OEt)_3$<br>m + n = 40–180, m/n = 0.5–2.0 |
| Solvey/Ausimont | Fluorolink F10 | $(HO)_2\underset{\underset{O}{\|}}{P}OR_HF_2CO(CF_2CF_2O)_m(CF_2O)_nCF_2R_HO\underset{\underset{O}{\|}}{P}(OH)_2$<br>m + n = 40–180; m/n = 0.5–2.0 |
| Solvey/Ausimont | Fluorolink D10H | $HOCH_2F_2CO(CF_2CF_2O)_m(CF_2O)_nCF_2CH_2OH$<br>m + n = 40–180; m/n = 0.5–2.0 |

TABLE 5-continued

| Supplier | Tradename | Structure |
|---|---|---|
| Solvey/Ausimont | Fluorolink T10 | $HOCH_2\underset{\underset{OH}{\vert}}{C}HCH_2OCH_2F_2CO(CF_2CF_2O)_m(CF_2O)_nCF_2CH_2OCH_2\underset{\underset{OH}{\Vert}}{C}HCH_2OH$<br>m + n = 40–180; m/n = 0.5–2.0 |
| Dupont | Krytox Alcohol TLF-8976 | $F(\underset{\underset{CF_3}{\vert}}{C}FCF_2O)_n\underset{\underset{CF_3}{\vert}}{C}FCH_2OH$<br>n = 10 |
| Dupont | Krytox Phosphate KDP-4413 | $F(\underset{\underset{CF_3}{\vert}}{C}F_2CF_2O)_n\underset{\underset{CF_3}{\vert}}{C}FCH_2O\underset{\underset{O}{\Vert}}{P}(OH)_2$<br>n = 10 |

Silane functionality is illustrated by the —$Si(OEt)_3$ groups of Fluorolink S10. The PFPEs may be monofunctional, difunctional, trifunctional, or tetrafunctional. For example, Krytox Alcohol TLF-8976 in the Table has a single hydroxyl functional group. Fluorolink D10H illustrates difunctional hydroxyl PFPEs, while Fluorolink T10 is a non-limiting example of a tetrahydroxy functional PFPE. In further non-limiting examples, phosphate functional PFPEs may be monofunctional or difunctional. These are illustrated by Krytox Phosphate KDP-4413 and Fluorolink F10, respectively, in the table.

Effective defoaming capability of the PFPEs of the invention depends in part on its insolubility in the process medium in which it acts. In automatic transmission fluid, the antifoam additive is dispersed as a second liquid phase. The second phase has a tendency to segregate itself to reside at liquid air interfaces, including bubbles, due to its limited solubility. Although the insoluble nature of the antifoam compounds leads to its antifoam performance, the insolubility imposes limitations on the maximum concentration that can be blended into a stable dispersion with suitable shelf life for commercial use. The PFPEs of the invention may be blended into automatic transmission fluid with high shear blending processes to mix in a limited concentration of antifoam agent. As discussed further below, it is also possible to make supplemental additions, or "top treats" of the PFPEs of the invention directly into the automatic transmission. Whenever the PFPE is added, it is preferred to use a PFPE having a viscosity in the range of about 1–150,000 centisokes to allow for blending into the ATF, either at the formulator's facility with high shear blending equipment, or in the sump of an automatic transmission system.

Treat levels of the PFPEs of the invention should be as low as practical to avoid excessive costs, but should be at levels sufficient to reduce the foam and the cavitation or pump whine noise associated with the foam. Generally, the PFPE should be present in the ATF at a level from about 5 ppm (0.0005%) to about 1% by weight. More preferably, the maximum level of PFPE is 0.5%, and more preferably the ATF contains up to 0.3% by weight of the PFPE. In a preferred embodiment, PFPE is added to the automatic transmission fluid at a level of 0.0005% to 0.269% by weight. In a continuously variable transmission having a sump volume of 8 liters, for example, 3 ml of a PFPE of the invention may be injected. In another embodiment, a treat level of 0.188% by weight is used. It is preferred to inject the PFPE into the automatic transmission fluid as a solution in a base oil. For example, a top treat composition may be made up comprising 3 ml of PFPE and 7 ml of a lubricating oil. The top treat composition is then added to the automatic transmission fluid in the sump.

The treatment level of PFPE in automatic transmission fluids will be influenced by the presence of other performance additives in the fluid, especially as the other additives affect the amount of air entrainment in the fluid. Examples of such additives include pour point depressants, viscosity index improvers, antioxidants, corrosion inhibitors, extreme pressure agents, antiwear agents, and other antifoam agents. The blended automatic transmission fluids containing the antifoam compositions of the invention must generally exhibit a flash point greater than about 170° C., withstand oxidation, suppress volatilization, and resist breakdown. Further, the blended ATFs must exhibit non-foaming characteristics at high temperatures and pressures and low viscosity at low temperature.

In addition to the base lubricating oil and the PFPE antifoam compounds, formulated ATFs contain a number of other conventional additives such as:

boronated or non-boron dispersants;
anti-oxidation compounds;
seal swell compositions;
friction modifiers;
extreme pressures/antiwear agents;
viscosity modifiers;
pour point depressants; and
detergents.

The automatic transmission fluid should meet or exceed the specifications of the car manufacturer. An example of a suitable ATF is GM DEX-CVT®, which is a continuously variable transmission fluid meeting both GM 10028N end GM 9986220 specifications.

The base oils used in forming the automatic transmission fluids of this invention can be any suitable natural or synthetic oil having the necessary viscosity properties. Thus, the base oil may be composed entirely of a natural oil such as mineral oil of suitable viscosity or it may be composed entirely of a synthetic oil such as a poly-alpha-olefin of suitable viscosity. Likewise, the base oil may be a blend of natural and synthetic base oils provided that the blend has the requisite properties for use in the formation of an automatic transmission fluid. Ordinarily, the base oil should have a kinematic viscosity in the range of 2 to 50 centistokes, preferably 3 to 8 centistokes (cSt), at 100° C. Preferred base oils are Group III stocks. A preferred base oil viscosity is, for example, 3.8 cSt for the ratio of VHVI 2 and VHVI 4 that is used. In an embodiment of the present invention, the individual viscosities of those base stocks are 2.8 cSt and 4.3 cSt, respectively.

ATFs of the invention preferably contain detergent and dispersants. They function in part to solubilize fluid components and to suspend insoluble materials that build up over time during operation. In one embodiment, the detergent/dispersant contains a first component (such as an N-aliphatic alkyl substituted diethanolamine) and a second component comprising either an oil soluble phosphorus containing ashless dispersant and/or at least one oil-soluble boron-containing ashless dispersant. The ashless dispersants are present in amount such that the ratio of boron in the ashless dispersant is in the range of about 0.05 to about 0.2 part by weight of boron per part by weight of the first component, or the ratio of phosphorus in the ashless dispersant is about 0.1 to 0.4 parts per part by weight of the first component.

In one embodiment, the compositions of this invention contain at least one oil-soluble phosphorus- and boron-containing ashless dispersant present in an amount such that the ratio of phosphorus to the first component is in the range of about 0.15 to about 0.3 part by weight of phosphorus per part by weight of the first component, and such that the ratio of boron in the ashless dispersant is in the range of about 0.05 to about 0.15 part by weight of boron per part by weight of the first component.

Phosphorus- and/or boron-containing ashless dispersants can be formed by phosphorylating and/or boronating an ashless dispersant having basic nitrogen and/or at least one hydroxyl group in the molecule, such as a succinimide dispersant, succinic ester dispersant, succinic ester-amide dispersant, Mannich base dispersant, hydrocarbyl polyamine dispersant, or polymeric polyamine dispersant.

The ATFs also contain antiwear agents in a level suitable for protecting the moving components (e.g., the pump and the gears of the transmission) from wear. Typically, the antiwear additives will be present at a level of about 0.025 to about 5% by weight of the ATF. A non-limiting example of a suitable antiwear agent is 2,5-dimercapto-1,3,4-thiadiazole (DMTD) or derivatives thereof. To illustrate, derivatives of DMTD include:

a) 2-hydrocarbyldithio-5-mercapto-1,3,4-thiadiazole or 2,5-bis(hydrocarbyldithio)-1,3,4-thiadiazole and mixtures thereof;
b) carboxylic esters of DMTD;
c) condensation products of halogenated aliphatic monocarboxylic acids with DMTD;
d) reaction products of unsaturated cyclic hydrocarbons and unsaturated ketones with DMTD;
e) reaction products of an aldehyde and diaryl amine with DMTD;
f) amine salts of DMTD;
g) dithiocarbamate derivatives of DMTD;
h) reaction products of an aldehyde and an alcohol or aromatic hydroxy compound and DMTD;
i) reaction products of an aldehyde, a mercaptan and DMTD;
j) 2-hydrocarbylthio-5-mercapto-1,3,4-thiadiazole; and
k) products from combining an oil soluble dispersant with DMTD; and mixtures thereof.

Compositions a)–k) are described, for example, in U.S. Pat. No. 4,612,129 and patent references cited therein, the disclosures of which are incorporated by reference. Thiadiazoles are commercially available, for example, from the Ethyl Corporation as HiTEC® 4313.

Depending on the base stocks that are chosen, an amount of seal swell agent may be required to meet the OEM seal compatibility requirements. Use of Group II, Group III and Group IV base oils many times requires the addition of a material to swell seals. These materials may be chosen from the general categories of oil soluble diesters, aromatic base oils, and sulfones. Alkyl adipates are examples of soluble diesters that can be used. In a preferred embodiment, alkyl adipate is used at a treat rate of 3 to 20%, more preferably 3 to 10%, and most preferably about 5%.

A viscosity index improver is useful in the formulations and methods of the present invention and can include, but is not limited to, one or more materials selected from polyacrylate, polymethacrylate, styrene/olefin copolymer, styrene diene copolymer, EP copolymer or terpolymers, and combinations thereof. A preferred VI improver is a highly shear stable polymethacrylate polymer or copolymer used at, for example, about 15 percent by weight in the fluid formulation. VI improvers are commercially available.

The automatic transmission fluids of the invention may be used as lubricating compositions and hydraulic fluids in a variety of automotive transmissions. In one embodiment, the transmission has a sump volume of 13 liters (L) or less. In a preferred embodiment, the transmissions are continuously variable transmissions (CVT) with a sump of 9 L or less, preferably 8 L or less. One advantage of the ATFs of the invention is that they reduce foam or entrained air in an ATF. This has the effect of reducing or eliminating the pump whine caused by the implosion of air bubbles on the pressure side of the pump. Because of the high pressures involved, the problem is most pronounced in automatic transmissions in general, and in CVTs in particular. For this reason, in a preferred embodiment, the ATFs of the invention are used as hydraulic and lubricating fluids in continuously variable transmissions. The CVTs may be configured as transmissions for rear drive cars or as transaxles for front wheel drive cars.

One method of treating an automatic transmission having ATF therein according to the present invention includes the step of adding into the transmission a composition comprising an antifoam agent, with or without a diluent or carrier oil. This step of adding the antifoam agent composition may be performed by direct injection thereof into the transmission, such as by syringe, a metering apparatus, or otherwise. Also, this step may be performed at any of several stages during the lifetime of the vehicle—at the initial building of the transmission; at its initial installation into a vehicle; at prescribed service intervals; when pump whine is or has been noticed; at any servicing, maintenance or rebuilding of the transmission; at any topping off, filling or refilling of the transmission with fluid; and at other times.

For example, one method according to the present invention comprises the steps of: (a) building a new automatic transmission, (b) filling the transmission with ATF, (c) performing functional tests on the transmission, (d) removing some portion (e.g., one-half) of the ATF from the transmission, (e) adding an antifoam top treat composition into the partially-filled transmission, (f) shipping the transmission (e.g., to a dealer, service site, etc.), and (g) filling up the transmission with ATF. This process may optionally include the step of installing the transmission into a vehicle after step (a).

Alternatively, rather than adding the antifoam agent into the transmission (i.e., top treating the transmission), a method according to the present invention also includes the step of mixing the antifoam agent with an ATF prior to filling or topping off an automatic transmission with initial or additional ATF. The antifoam agent-rich ATF may then be used to fill, refill, or top off an automatic transmission, so as to reduce previously noticed pump whine or to guard against potential pump whine.

It should be noted that the step of adding the top treat composition or formulated ATF to a transmission according to the present invention may include adding such into the transmission case, the sump, the pump itself, a fill tube, a dipstick tube, a service port, the torque converter, the valve body, an accumulator, the hydraulic lines, or elsewhere in direct or indirect fluid communication with the pump. The location where the top treat or fully-formulated ATF is added may be proximate the transmission, or it may be at some relatively distant point from the transmission, such as at a suitable port in the pump/transmission hydraulic lines adjacent the radiator/condenser/oil cooler.

A method for reducing unwanted noise in an operating automatic transmission may be carried out by top treating the lubricating composition contained in the lubricant sump of the transmission with a top treat composition containing an antifoam compound such as described above. In a preferred embodiment, the antifoam compound is thermally stable, as measured by differential thermal analysis, to a temperature of 200° C. or more, preferably 400° C. or more, and most preferably 500° C. or more. As a general rule, the antifoam compound in the ATFs of the invention see the high temperatures at the imploding bubble surfaces for a relatively short period of time. For this reason, it is possible to use an antifoam agent with a thermal stability as measured by differential thermal analysis of less than the preferred ranges. However, for best results, it is preferred to use an antifoam agent that is thermodynamically stable at temperatures obtaining on the pressure side of the pump when the bubbles are adiabatically compressed.

The top treating of the lubricating composition in the sump may be carried out after assembly of the transmission at a transmission plant and before shipping the transmission to an automotive assembly line. Alternatively or in addition, the top treating step may be carried out at the automotive assembly line prior to shipping the car containing the transmission to a customer.

In the aftermarket, the top treating step may be carried out during scheduled maintenance of the transmission, or when the operator of a vehicle notices a noise originating from the transmission. The top treating step may be carried out by an automotive technician at a repair facility, or may be performed by the consumer.

The description of the invention is merely exemplary in nature and, thus, variations that do not depart from the gist of the invention are intended to be within the scope of the invention. Such variations are not to be regarded as a departure from the spirit and scope of the invention.

The invention claimed is:

1. An automatic transmission comprising a housing defining a lubricant sump, wherein the lubricant sump contains a lubricating oil composition comprising:

a) a lubricating oil;

b) an antiwear agent; and c) an antifoam composition comprising a perfluoropolyether compound, wherein the perfluoropolyether compound comprises a perfluoroether repeating unit selected from the group consisting of —$C_aF_{2a}O$— repeating units, wherein a is from 1 to 2 or 4 to 10:

—($CF_2$—$CF_2$—$CF_2$—O)—;

—($CF_2$—$CF_2$—O)—; and

—($C_b$ $F_{2b}$O)— and —($CF_2$—O)—, wherein b is 2–10.

2. An automatic transmission according to claim 1, wherein the perfluoropolyether compound comprises a plurality of —($C_aF_{2a}O$)— repeating units, wherein a is from 1 to 2 or 4 to 10.

3. An automatic transmission according to claim 1, wherein the perfluoropolyether comprises repeating units of —($CF_2$—$CF_2$—$CF_2$—O)—.

4. An automatic transmission according to claim 1, wherein the perfluoropolyether comprises repeating units of —($CF_2$—$CF_2$—O)—.

5. An automatic transmission according to claim 1, wherein the perfluoropolyether comprises repeating units of —($C_bF_{2b}O$)— and—($CF_2$—O)—, wherein b is 2–10.

6. An automatic transmission according to claim 5, wherein the perfluoropolyether contains the repeating units in a random distribution along the backbone.

7. An automatic transmission according to claim 2, wherein the perfluoropolyether further comprises one or more functional groups selected from the group consisting of alkyl amide, silane, phosphate, carboxyl, ester, and hydroxyl.

8. An automatic transmission according to claim 1, wherein the fluid comprises 0.0005% to 1% by weight of the perfluoropolyether compound.

9. A transmission according to claim 1, wherein the transmission is a continuously variable transmission.

10. A transmission according to claim 1, wherein the volume of the lubricant sump is 13 liters or less.

11. A transmission according to claim 1, wherein the volume of the lubricant sump is 9 liters or less.

12. A method for reducing noise during operation of an automobile automatic transmission, comprising lubricating the transmission with a lubricating composition comprising a perfluoropolyether compound, wherein the perfluoropolyether compound comprises at least one perfluoroether repeating unit of structure —($C_aF_{2a}O$)—, wherein a is 1 to 10, other than —($CF_2$—$CF(CF_3)$O)—.

13. A method according to claim 12, wherein the perfluoropolyether comprises repeating units of —($CF_2$—$CF_2$—$CF_2$—O)—.

14. A method according to claim 12, wherein the perfluoropolyether comprises repeating units of —($CF_2$—$CF_2$—O)—.

15. A method according to claim 12, wherein the perfluoropolyether comprises repeating units of —($C_bF_{2b}O$)— and —($CF_2$—O)—, wherein b is 2–10.

16. A method according to claim 15, wherein the perfluoropolyether contains the repeating units in a random distribution along the backbone.

17. A method according to claim 12, wherein the perfluoropolyether further comprises one or more functional groups selected from the group consisting of alkyl amide, silane, phosphate, carboxyl, ester, and hydroxyl.

18. A method according to claim 12, wherein the fluid comprises 0.0005% to 1% by weight of the perfluoropolyether compound.

19. A method according to claim 12, wherein the transmission is a continuously variable transmission.

20. A method of treating an automatic transmission, the transmission comprising a housing defining a lubricant sump, wherein the sump contains a lubricating composition, the method comprising adding to the lubricating composition in the sump a top treat composition comprising a perfluoropolyether compound that comprises a fluoroether repeating unit other than —($CF_2CF(CF_3)O$)—.

21. A method according to claim 20, wherein the perfluoropolyether compound comprises a plurality of —($C_aF_{2a}O$)— repeating units, wherein a is from 1 to 10.

22. A method according to claim 20, wherein the perfluoropolyether compound comprises repeating units of —($CF_2$—$CF_2$—$CF_2$—O)—.

23. A method according to claim 20, wherein the perfluoropolyether compound comprises repeating units of —($CF_2$—$CF_2$—O)—.

24. A method according to claim 20, wherein the perfluoropolyether compound comprises repeating units of —($C_bF_{2b}O$)— and —($CF_2$—O)—, wherein b is 2–10.

25. A method according to claim 24, wherein the perfluoropolyether compound contains the repeating units in a random distribution along the backbone.

26. A method according to claim 20, wherein the pert luoropolyether compound comprises one or more functional groups selected from the group consisting of alkyl amide, silane, phosphate, carboxyl, ester, and hydroxyl.

27. A method according to claim 20, wherein the fluid comprises 0.0005% to 1% by weight of the perfluoropolyether compound.

28. A method according to claim 20, wherein the transmission is a continuously variable transmission.

* * * * *